US005852408A

United States Patent [19]

Christiansen et al.

[11] Patent Number: 5,852,408

[45] Date of Patent: Dec. 22, 1998

[54] MEDICATION DISPENSING AND COMPLIANCE MONITORING SYSTEM

[76] Inventors: Steven Aagard Christiansen, Box 43; Steven John Colling, Box 161; George Henry Weiser, Box 474, all of Meeteetse, Wyo. 82433

[21] Appl. No.: 543,670

[22] Filed: Oct. 16, 1995

[51] Int. Cl.[6] ..... G08B 19/00

[52] U.S. Cl. ..... 340/870.09; 340/309.15; 340/568; 379/38; 379/46

[58] Field of Search ..... 340/870.09, 870.01, 340/870.16, 568, 573, 309.15; 364/479.01, 569; 128/630, 920; 221/9, 15; 379/38, 40, 45, 46, 51

[56] References Cited

U.S. PATENT DOCUMENTS 4,911,327 3/1990 Shepherd et al. ..... 221/15

*Primary Examiner*—Michael Horabik
*Assistant Examiner*—Andrew Hill
*Attorney, Agent, or Firm*—Risto A. Rinne, Jr.

[57] ABSTRACT

A system includes a medication dispensing device that is adapted for dispensing a medication to a patient at a predetermined time interval and includes a method for the detection of the timely removal of the medication from the device. When the medication is not timely removed from the device a signal of non-compliance is generated and is received by an alarm system that is adapted to summon help. According to a first embodiment the alarm system places a telephone call to a care-giver or, if the care-giver is unresponsive, to an alternate care-giver who in turn makes contact with the patient. According to a second embodiment the alarm system places a telephone call to a central monitoring station which attempts to make contact with the patient by use of a two-way speaker phone that is included in the alarm system. In the event the patient is unresponsive to communication over the speaker phone, a person at the central monitor station places a telephone call to a care-giver or, if the care-giver is unresponsive, to an alternate care-giver who in turn makes contact with the patient. According to an alternative embodiment the alarm system is incorporated into the medication dispensing device as a component thereof.

17 Claims, 1 Drawing Sheet

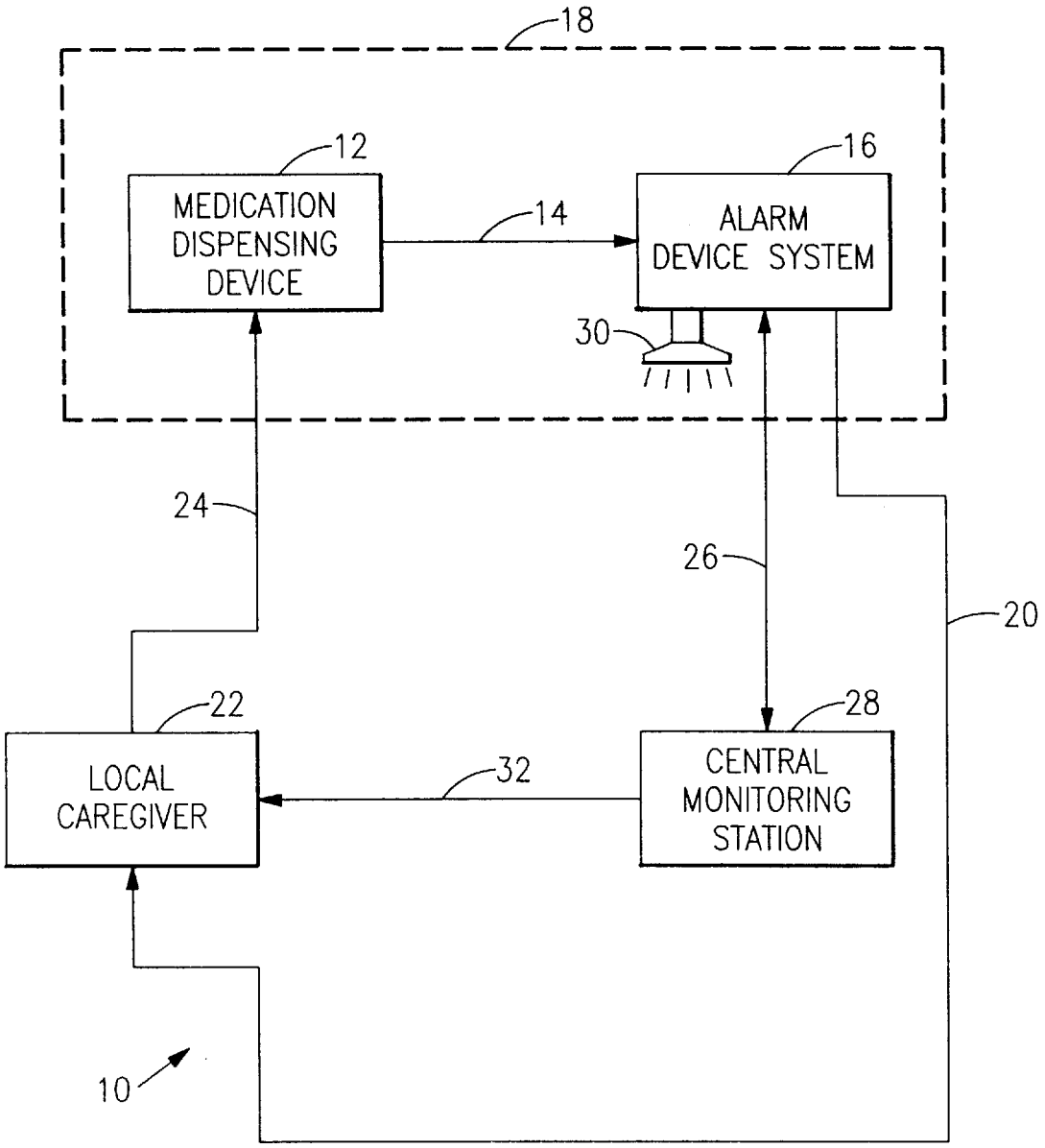
18
12
MEDICATION DISPENSING DEVICE
14
16
ALARM DEVICE SYSTEM
30
24
26
20
22
LOCAL CAREGIVER
32
28
CENTRAL MONITORING STATION
10

MEDICATION DISPENSING AND COMPLIANCE MONITORING SYSTEM

BACKGROUND OF THE INVENTION

1. Field of the Invention

The present invention, in general, relates to apparatus which automatically dispense medications and, more particularly, to devices which, upon detection of non-compliance by the patient in taking medications are useful in summoning help.

Devices which automatically dispense medications to patients are know. See prior art U.S. Pat. No. 4,763,810 to Christiansen, which issued Aug. 16, 1988. These types of devices dispense prescribed medications to a patient at regular intervals, usually at the home of the patient. A light, a bell, a display, or some other signaling device notifies the patient that medication has been dispensed and is available to be taken.

Normally upon the patient removing the medication from a drawer, the medication dispensing device inferentially determines that compliance has occurred. However if a patient is unable for any reason to take the medication from the dispenser, a condition of non-compliance exists which may warrant outside intervention.

For example, failure of a patient to remove medication from the drawer of the medication dispensing device may indicate that the condition of the patient has deteriorated and that he or she is unable to take the medication. The patient may be unconscious, injured, or otherwise incapacitated.

As such an automated medication dispensing device is uniquely able to detect potentially serious changes in the status of a patient based upon the non-compliance of the patient in the taking of medications.

Patient signaling devices (also called alarms or types of Personal Emergency Response Systems), for when a patient becomes injured or the like are also known. Usually these types of devices are activated by a patient pressing a button which activates the signaling device which then summons help according to a programmed sequence over the telephone. However such devices cannot detect an unconscious or totally incapacitated patient that is unable even to push a button, or perhaps even unaware that he or she should in fact summon help.

As the non-compliance of the patient in the taking of medications can infer such conditions, a medication dispensing device can potentially provide better monitoring of the status of a patient at home by inference.

Accordingly there exists today a need for a medication dispensing device that can detect non-compliance and summon help when needed.

2. Description of Prior Art

Medication dispensing devices are, in general, known. For example, prior art U.S. Pat. No. 4,763,810 to Christiansen, which issued Aug. 16, 1988 describe such a device. An example of a personal alarm is manufactured by TELE LARM model TT90. No patent information is available regarding the TELE LARM device.

While the structural arrangements of the above described types of devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a medication dispensing and compliance monitoring system that can detect non-compliance of a patient in taking medication and summon help.

It is also an object of the invention to provide a medication dispensing and compliance monitoring system that can detect non-compliance of a patient in taking medication and generate an alarm signal.

Another object of the invention is to provide a medication dispensing and compliance monitoring system that can detect non-compliance of a patient in taking medication and generate an alarm signal that is compatible for use with existing types of alarm systems.

Still another object of the invention is to provide a medication dispensing and compliance monitoring system that can detect non-compliance of a patient in taking medication and generate an alarm signal that is compatible for use with existing types of alarm systems that rely upon a central monitoring station.

Briefly, a medication dispensing and compliance monitoring system that is constructed in accordance with the principles of the present invention has a medication dispensing device in proximity to a patient that can detect non-compliance by the patient in taking medication. The medication dispensing device generates an alarm signal in response to a determination of a condition of non-compliance. According to a first embodiment, the medication dispensing device generates the alarm signal which is received by an existing type of a personal emergency response system, also in proximity to the patient. The personal emergency response system accordingly detects the condition of non-compliance and, depending upon the type of system either notifies by telephone various care-givers or emergency personnel who, in turn, check upon the status of the patient or alternatively according to a second embodiment, the response system notifies a central monitoring station which first attempts to make contact with the patient (by a speaker phone also in proximity to the patient or by a telephone call to the patient or to a neighbor) and, if unsuccessful, the central monitoring station then telephones various care-givers or emergency personnel who, in turn, check upon the status of the patient. According to an alternative embodiment, the medication dispensing device includes as a component therein circuitry and programming that, upon detection by the device of non-compliance, notifies by connection to a telephone various care-givers or emergency personnel who, in turn, check upon the status of the patient.

BRIEF DESCRIPTION OF THE DRAWINGS

FIG. 1 is a block diagrammatic view of a medication dispensing and compliance monitoring system.

DETAILED DESCRIPTION OF THE INVENTION

Referring to FIG. 1 is shown, a medication dispensing and compliance monitoring system, identified in general by the reference numeral 10.

A medication dispensing device 12 is shown as one component part, although such a device 12 is actually a known type of assembly consisting of many components including a computer (not shown) and the programming necessary to operate the computer as well as a configuration of circuitry (not shown) which governs the operation of the device 12.

As it is not an object of the present disclosure to invent a new type of a medication dispensing device (not shown), no detail of construction of the device 12 are included other than reference to prior art U.S. Pat. No. 4,763,810 to Christiansen, which issued Aug. 16, 1988 and is incorporated herein as a reference.

Rather, the present disclosure includes one general improvement relating to the medication dispensing device 12 as a component of the medication dispensing and compliance monitoring system 10 and that is the generation and the subsequent use of a signal of non-compliance that is identified in the drawing figure as reference numeral 14.

The signal 14 originates in the device 12 and is directed to be received by an alarm system 16. The device 12 therefore generates the signal 14, the attributes of the signal which are described in greater detail hereinafter. The alarm system 16 receives the signal 14.

The connection between the device 12 and the alarm system 16 may be "hard wired" or by other means such as an RF signal, an IR (infrared) signal, or the like. The means to transmit the signal 14 from the device 12 to the alarm system 16 is a design variable that is selected based upon various factors including maintaining optimum compatibility with the alarm system 16, and this is also described in greater detail hereinafter.

The alarm system 16 and the device 12 are shown, generally inside of a dashed line 18. The dashed line represents the equipment that is in the home or in the vicinity of a patient (not shown), the significance of which is described in greater detail hereinafter.

The signal 14, as was mentioned hereinabove, indicates non-compliance by the patient in the removal (and the assumed usage) of a medication (not shown). Depending upon the particular circumstances of the patient, the requirements for the generation of the signal 14 vary.

A condition of non-compliance by the patient involves determining if an appropriate amount of time intermediate the dispensing of the medication by the device 12 and the removal of the medication from the device 12 has been exceeded. The device 12 may include a drawer (not shown) into which the medication is dispensed and from which it is removed for use by the patient, as was disclosed in prior U.S. Pat. No. 4,763,810 to Christiansen that issued Aug. 16, 1988.

Timely removal of the medication from the drawer indicates compliance whereas a failure to remove the medication from the drawer within a predetermined interval of time intermediate the dispensing of the medication by the device 12 into the drawer and the removal of the medication from the drawer indicates a condition of non-compliance.

For example, for certain critically ill patients, only a brief delay between the device 12 dispensing of the medication and failure to remove the medication from the device 12 will result in the generation of the signal 14. However for certain patients a very long time delay may be programmed into the device 12 before the signal 14 is actually generated by the device 12.

As a further example, under special conditions, the signal 14 is not generated for non-compliance of certain non-critical medications but is generated when the patient fails to remove critical medications from the device 12. The generation of the signal 14 is controlled by the device 12 and, accordingly, the device 12 may be programmed to generate the signal 14 as desired.

The examples, as mentioned hereinabove, are for way of example only and not intended to define the only circumstances for generation of the signal 14. However in general the signal 14 is an indication of the non-compliance of the patient with regard to removing medication from the device 12.

When the signal 14 is a radio frequency or RF signal (not shown) or as an infrared-red or IR signal (not shown) it is transmitted or broadcast by the device 12. Accordingly the alarm system 16 must be adapted to receive the signal 14. Therefore the alarm system 16 includes a receiver (not shown) which is adapted to receive and interpret the signal 14 as that of non-compliance.

As an alternative embodiment, the alarm system 16 is included as a component part of the medication dispensing device 12. The device 12 is constructed with sufficient room therein to house the components of the alarm system 16 and to perform the function of the alarm system 16 as is described in greater detail hereinbelow. When the alarm system 16 is included as a component of the device, the dashed line 18 then represents the components that are housed inside of the medication dispensing device 12.

The alarm system 16 functions as a communications device that is activated by its detection of an alarm condition. The patient typically presses a button (not shown) that is worn by the patient which activates the alarm system 16, usually by the generation of an RF "panic" signal (not shown) and by the subsequent detection of the panic signal by the alarm system 16.

The alarm system 16 then determines according to an internal program whom to contact by telephone to provide help to the patient. This may be either the police or care-givers or other emergency personnel. Therefore the output of the alarm system 16, as is described in greater detail hereinbelow, is typically accomplished by telephone and of course requires the connection of the alarm system 16 to a telephone line in the house. Usually the telephone line must accommodate touch tone dialing.

The alarm system 16 according to a first embodiment the alarm system 16 generates a first help signal 20. The first help signal 20 notifies directly by telephone a local care-giver 22 that is located near to the patient and is able to create a visit to the patient as identified in general by reference numeral 24. The alarm system identifies itself to whoever answers the phone and states a pre-recorded message as to the nature of the call. In this instance it would indicate non-compliance by the patient.

The local care-giver 22 may consist of a nurse at a professional nursing pool, an alternate care-giver, a policeman, a family member or even a neighbor if desired. In use the alarm system 16 attempts to contact whomever is desired by telephone in response to detection of the first help signal 20. If the first call is not answered, then the alarm system 16 attempts to contact a second contact and third contact and so on depending upon the parameters that are programmed into it.

If the alarm system 16 is not activated by the signal of non-compliance but instead by the patient pressing the panic button and generating the RF "panic" signal, then the alarm system might call the police first. Who is called, and the alternated contacts are parameters that are programmed into the alarm system 16.

The visit 24 includes the local care-giver 22, or a representative (not shown) of the care-giver 22 going to see the patient, determining the emergency needs of the patient and accomplishing whatever is required. The care-giver 22 might for example summon an ambulance (not shown) or otherwise administer to the patient. If the patient failed to take the medication and no emergency condition was found to exist, the local care-giver would assist the patient in taking the medication before leaving.

The care-giver 22 would deactivate the signal of non-compliance 14 from the device 12 and also the first help signal 20 of the alarm system 16 if this was not automatically deactivated by deactivation of the signal of non-compliance 14.

According to a second embodiment, the alarm system 16 generates a second help signal 26 by telephone to a central monitoring station 28 that is always on line and ready to receive the second help signal 26.

The second help signal 26 is shown as being two way communications between the alarm system 16 and the central monitoring station 28. The reason for this is because a person (not shown) at the central monitoring station 28 would attempt to contact the patient by speaking through a two-way speaker phone 30 that is attached to the alarm system 16.

If the patient were simply sleeping and accordingly failed to take the medication, the patient might hear the person speaking and could answer accordingly that he or she was now going to take the medication. Doing so would then deactivate the signal 14 and accordingly deactivate the second help signal 26.

If there was no response by the patient over the speaker phone 30, then the person at the central monitoring station 28 would make a priority telephone call, identified by the reference numeral 32, to the local care-giver 22 who would respond as was described hereinabove.

Accordingly a medication dispensing and compliance monitoring system 10 has been described wherein the detection of a condition of non-compliance by the patient is useful in summoning help.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A medication dispensing and compliance monitoring system, comprising:

(a) a medication dispensing device adapted to automatically dispense a predetermined medication at a predetermined time to a patient, said medication dispensing device including means for detecting non-compliance by said patient to remove said medication from said medication dispensing device wherein said means for detecting non-compliance includes means for determining an amount of time intermediate the dispensing of said medication by said medication dispensing device into a drawer of said medication dispensing device and the removal of said medication from said drawer of said medication dispensing device and by comparing said amount of time to a predetermined limit, and including means for generating a signal responsive to said means for detecting non-compliance whereupon a determination of said amount of time exceeding said predetermined limit results in the activation of said means for generating said signal; and (b) an alarm system including means for responding to said signal, said means for responding adapted for summoning help for said patient wherein said means for responding to said signal includes means for placing a telephone call to a predetermined telephone number to summon help for said patient and including means for placing at least one additional telephone call to an alternative predetermined telephone number when said telephone call is not answered within a predetermined interval.

2. The medication dispensing and compliance monitoring system of claim 1 wherein said alarm system is disposed external with respect to said medication dispensing device.

3. The medication dispensing and compliance monitoring system of claim 1 wherein said alarm system is disposed internal with respect to said medication dispensing device.

4. The medication dispensing and compliance monitoring system of claim 1 wherein said alarm system is adapted to play a pre-recorded message subsequent to an answer at said predetermined telephone number.

5. The medication dispensing and compliance monitoring system of claim 1 wherein said means for responding to said signal includes means for placing a telephone call to a central monitoring station to summon help for said patient, said central monitoring station including means for answering said telephone call and including personnel adapted to take appropriate action in response thereto.

6. The medication dispensing and compliance monitoring system of claim 5 wherein said means for placing said telephone call to said central monitoring station includes means for playing a pre-recorded message that is played subsequent to an answer at said central monitoring station.

7. The medication dispensing and compliance monitoring system of claim 5 wherein said means for responding includes a two-way speaker phone adapted for communication between said patient and said central monitoring station.

8. A medication dispensing and compliance monitoring system, comprising:

(a) a medication dispensing device adapted to automatically dispense a predetermined medication at a predetermined time to a patient, said medication dispensing device including means for detecting non-compliance by said patient to remove said medication from said medication dispensing device wherein said means for detecting non-compliance includes means for determining an amount of time intermediate the dispensing of said medication by said medication dispensing device and the removal of said medication from said medication dispensing device and by comparing said amount of time to a predetermined limit, and including means for generating a signal responsive to said amount of time exceeding said predetermined limit; and (b) an alarm system including means for responding to said signal, said means for responding including means for placing a telephone call to a central monitoring station to summon help for said patient, said central monitoring station including means for answering said telephone call and including personnel adapted to take appropriate action in response thereto.

9. The medication dispensing and compliance monitoring system of claim 8 wherein said medication dispensing and compliance monitoring system includes means for conversing with a patient disposed proximate to said medication dispensing device and with said personnel at said central monitoring station.

10. The medication dispensing and compliance monitoring system of claim 9 wherein said means for conversing includes a two-way speaker phone at said central monitoring station and at said medication dispensing and compliance monitoring system.

11. A medication dispensing and compliance monitoring system, comprising:

(a) a medication dispensing device adapted to automatically dispense a predetermined medication at a predetermined time to a patient, said medication dispensing device including means for detecting non-compliance by said patient to remove said medication from said medication dispensing device wherein said means for detecting non-compliance includes means for determining an amount of time intermediate the dispensing of said medication by said medication dispensing device and the removal of said medication from said medication dispensing device and by comparing said amount of time to a predetermined limit, and including means for generating a signal responsive to said amount of time exceeding said predetermined limit, and including means for varying said predetermined limit; and (b) an alarm system including means for responding to said signal, said means for responding including means for placing a telephone call to summon help for said patient.

12. The medication dispensing and compliance monitoring system of claim 11 wherein said means for varying is varied to accommodate the dosage requirements of said medication.

13. The medication dispensing and compliance monitoring system of claim 11 wherein said means for varying is varied to accommodate the individual requirements of said patient.

14. A medication dispensing and compliance monitoring system, comprising:

(a) a medication dispensing device adapted to automatically dispense a predetermined medication at a predetermined time to a patient, said medication dispensing device including means for detecting non-compliance by said patient to remove said medication from said medication dispensing device wherein said means for detecting non-compliance includes means for determining an amount of time intermediate the dispensing of said medication by said medication dispensing device and the removal of said medication from said medication dispensing device and by comparing said amount of time to a predetermined limit, and including means for generating a signal responsive to said amount of time exceeding said predetermined limit, said signal being a radio frequency transmission from said medication dispensing device;

(b) an alarm system including means for responding to said signal, said means for responding including means for placing a telephone call to summon help for said patient; and (c) a radio receiver operatively attached to said alarm system, said radio receiver adapted to receive said signal from said medication dispensing device.

15. The medication dispensing and compliance monitoring system of claim 14 wherein said alarm system includes means for receiving an emergency radio transmission from a transmitter carried by said patient subsequent to said patient depressing a switch attached to said transmitter, wherein reception of said emergency radio transmission causes said alarm system to place a telephone to an alternative predetermined party.

16. A medication dispensing and compliance monitoring system, comprising:

(a) a medication dispensing device adapted to automatically dispense a predetermined medication at a predetermined time to a patient, said medication dispensing device including means for detecting non-compliance by said patient to remove said medication from said medication dispensing device wherein said means for detecting non-compliance includes means for determining an amount of time intermediate the dispensing of said medication by said medication dispensing device and the removal of said medication from said medication dispensing device and by comparing said amount of time to a predetermined limit, and including means for generating a signal responsive to said amount of time exceeding said predetermined limit; and (b) a personal emergency response system including means for responding to said signal, said means for responding including means for placing a telephone call to summon help for said patient.

17. A medication dispensing and compliance monitoring system, comprising:

(a) a medication dispensing device adapted to automatically dispense a predetermined medication at a predetermined time to a patient, said medication dispensing device including means for detecting non-compliance by said patient to remove said medication from said medication dispensing device wherein said means for detecting non-compliance includes means for determining an amount of time intermediate the dispensing of said medication by said medication dispensing device and the removal of said medication from said medication dispensing device and by comparing said amount of time to a predetermined limit, and including means for generating a signal responsive to said amount of time exceeding said predetermined limit;

(b) an alarm system including means for responding to said signal, said means for responding including means for placing a telephone call to summon help for said patient; and (c) means for blocking said means for generating said signal, said means for blocking adapted to prevent the generation of said signal when said medication is deemed not to be critical to said patient.

* * * * *